United States Patent [19]

Kirkelund et al.

[11] Patent Number: 4,941,505

[45] Date of Patent: Jul. 17, 1990

[54] OIL SUPPLY SYSTEM FOR A BURNER NOZZLE INCLUDING MEANS FOR PREVENTING THE NOZZLE FROM DRIPPING

[75] Inventors: Poul Kirkelund, Broager; Jørn H. Klausen, Nordborg, both of Denmark

[73] Assignee: Danfoss A/S, Nordborg, Denmark

[21] Appl. No.: 336,000

[22] Filed: Apr. 10, 1989

[30] Foreign Application Priority Data

Apr. 29, 1988 [DE] Fed. Rep. of Germany ..... 3814530

[51] Int. Cl.[5] ..... F16K 23/00

[52] U.S. Cl. ..... 137/563; 137/599; 239/126

[58] Field of Search ..... 137/563, 565, 568, 599; 239/124, 126

[56] References Cited

U.S. PATENT DOCUMENTS

| | | | |
|---|---|---|---|
| 1,708,060 | 4/1929 | Harrison et al. | 137/599 X |
| 1,791,012 | 2/1931 | Ray | 137/599 X |
| 2,706,520 | 4/1955 | Chandler | 239/126 |
| 2,754,228 | 7/1956 | Bede | 239/124 X |
| 3,140,049 | 7/1964 | Norstrud et al. | 239/126 |
| 3,195,611 | 7/1965 | Tyler | 239/126 |
| 3,322,134 | 5/1967 | Enemark | 239/126 X |
| 3,358,928 | 12/1967 | Melendy | 239/126 X |
| 4,171,007 | 10/1979 | Bouteille | 137/599 |
| 4,182,354 | 1/1980 | Bergstedt | 239/126 X |
| 4,585,169 | 4/1986 | Kinsey | 239/126 X |

FOREIGN PATENT DOCUMENTS

| | | | |
|---|---|---|---|
| 861087 | 2/1961 | United Kingdom | 239/126 |

*Primary Examiner*—John Rivell

*Attorney, Agent, or Firm*—Wayne B. Easton; Clayton R. Johnson

[57] ABSTRACT

In order to prevent dripping in an oil supply system for a burner nozzle there is provided a pump stop valve in the supply line that connects the pressure outlet of the pump to the burner nozzle and a nozzle shut-off valve in the supply line between the pump stop valve and the nozzle. A circulating valve is provided in parallel to the pump stop valve to open when the pressure between the pump stop valve and the nozzle shut off valve is higher than the pressure at the pump outlet. As a result if the oil in the supply line adjacent the nozzle expands, oil can return through the circulating valve to the line between the pump stop valve and the pump outlet.

9 Claims, 3 Drawing Sheets

OIL SUPPLY SYSTEM FOR A BURNER NOZZLE INCLUDING MEANS FOR PREVENTING THE NOZZLE FROM DRIPPING

The invention relates to an oil supply system for a burner nozzle, comprising a pump, a pump stop valve disposed on the pressure side of the pump, and a nozzle shut-off valve disposed in the pipe line between the pump stop valve and the nozzle.

Such a system is known in many forms, for example in the Applicants' oil pumps of type MS 11.

In systems of this kind, one generally encounters the problem that, during periods when the burner is not in operation, oil drips from the nozzle of the oil burner. The reason for this is that the oil is heated in the nozzle pipe and expands. Unless measures are taken, this expansion results in oil dripping from the nozzle which leads to soiling in the combustion chamber and carbonising of the nozzle mouth. The heating has substantially two causes. For one thing, the residual heat present after the burner has been shut down is returned through the nozzle pipe, whereby the oil in the nozzle pipe is heated. For another, in oil burners with built-in preheaters, the oil is heated to a predetermined temperature upon starting of the burner before the pump is started. This results in so-called pre-dripping.

Various means are known intended to prevent or limit such dripping. These means are mostly based on the concept of providing the oil line with a relief line or relief bellows so that the oil line is either sucked empty or the oil remaining in the line can expand without dripping from the nozzle. Examples of such equipment are found in DE-OS No. 31 03 684, DE-OS No. 30 08 733, DE-OS No. 31 06 870 and U.S. Pat. No. 4 134 428.

In double line installations, relief is usually effected by way of the return line (U.S. Pat. No. 4 134 428). In single line installations, the relief line is connected to the suction side of the pump.

The aforementioned equipment working with a relief line involve constructional alterations of the pump and make the oil burner considerably more expensive because of additional valves and control equipment.

In the case of suggested solutions involving relief bellows, that is to say with a built-in chamber which expands under pressure, one encounters the problem of the chamber having a limited capacity. When employing this principle, the construction of the burner again becomes more complicated and thus more expensive.

Another known attempt at providing a solution involves bringing the stop valve as closely as possible to the nozzle (DE-OS No. 35 30 127). However, such a valve can effectively prevent dripping only if it is employed in conjunction with a form of relief as previously described because the forces occurring during expansion of the oil would otherwise open the valve again.

It is the problem of the present invention to provide pressure relief of the expanding oil that can be employed in single line and double line oil burner pumps and will effectively prevent dripping of the oil burner without thereby making the oil burner substantially more complicated or dearer.

This problem is solved in an oil supply system of the aforementioned kind in that a circulating valve which opens when the pressure between the pump stop valve and the nozzle shut-off valve is higher than the pressure on the pump pressure side is disposed in parallel with the pump stop valve. Upon expansion of the oil in the nozzle line, the oil can thus flow back through the circulating valve into the stationary pump.

A simply constucted and therefore economical form of this circulating valve is a check-valve which opens towards the pump. This check-valve need only have a low inherent closing force because, during operation of the pump, it is biased in the closing direction by the pressure side of the pump.

It is of particular advantage if the nozzle shut-off valve is disposed in the immediate vicinity of the nozzle to keep the oil line between the nozzle shut-off valve and the nozzle as short as possible.

In a preferred embodiment, the circulating valve can be built into existing oil supply systems without the need for making substantial changes to the pump unit. The oil flowing off through the circulating valve is thereby fed back directly to the pressure side of the pump where a nipple is generally provided.

In another preferred embodiment, the outlet of the circulating valve is led back directly to the inlet of the pump stop valve. This has the advantage that no additional lines are necessary.

It is of particular advantage if the pump stop valve and the circulating valve are constructed as a unit. An existing pump stop valve can then be replaced by the new unit. The oil supply system thus modified will then possess all the advantages of the invention without the need for making further alterations.

Such a unit preferably has a supply passage communicating with the pressure side of the pump, an intermediate passage communicating with the supply passage by way of a first valve which opens during operation of the pump, an outlet passage freely communicating with the nozzle and the intermediate passage, and an aperture in the wall of the intermediate passage that communicates with the supply passage and is closed by a second valve during operation of the pump, wherein the second valve opens when the pressure in the outlet passage is higher than the pressure in the supply passage. With the pump switched off, when the pressure on the pressure side of the pump drops, the oil can thus flow back into the supply passage through the outlet passage, the intermediate passage and the second valve.

An economical valve would in this case be a check-valve which, in another preferred construction, is formed by an elastic sleeve which closes the aperture in the wall of the intermediate passage.

Additional advantages, features and applications of the present invention will become evident from the subsidiary claims and the following description of examples in conjunction with the drawing. In the drawing:

Figure 1:
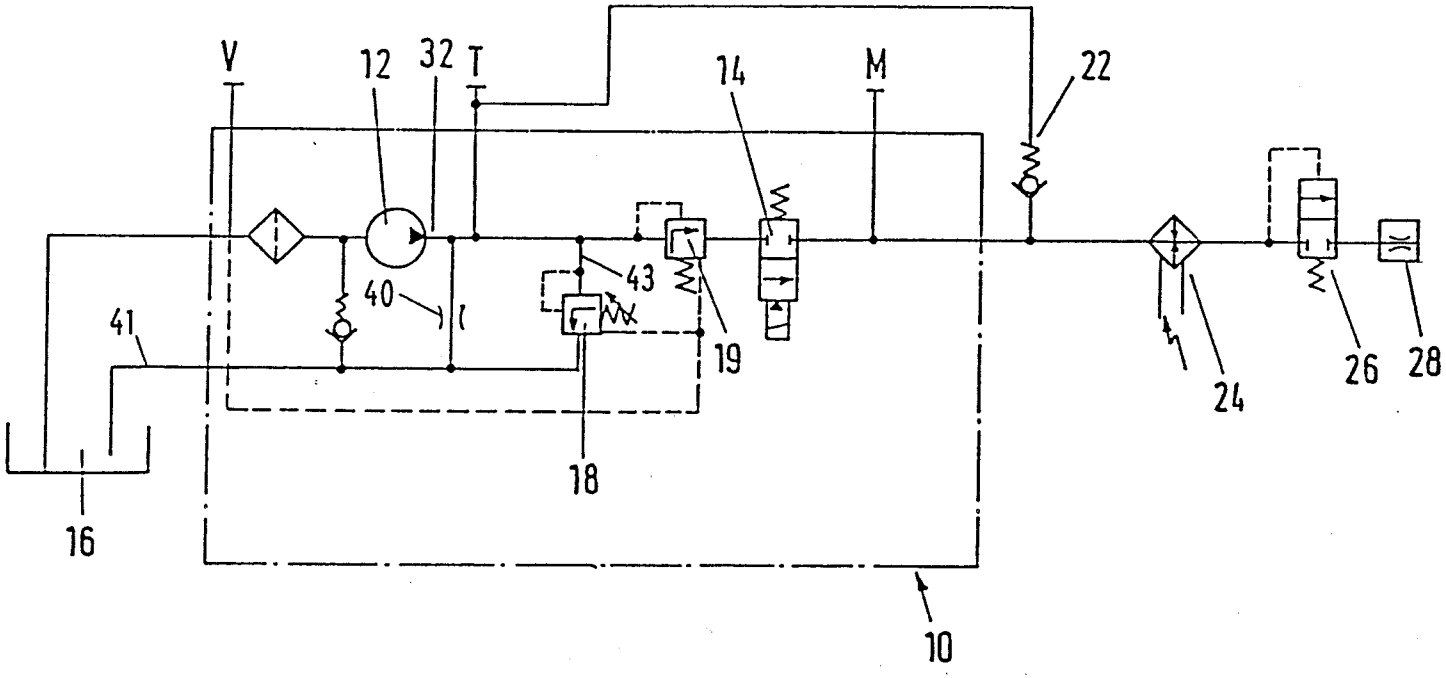
FIG. 1 shows an oil supply system for a burner nozzle.

The oil supply system in FIG. 1 comprises a conventional pump unit 10 which takes oil from an oil supply 16 and pumps it to a nozzle 28 by way of a preheater 24 and a nozzle shut-off valve. As is usual, the pump unit 10 comprises a pump 12 with pressure regulating devices 18, 19 at its pressure side. Between one pressure regulating device 19 and the outlet of the pump unit 10, there is a pump stop valve 14 which blocks the flow of oil when the pump 12 is shut off.

The conventional throttle 40 which has a very small orifice is connected to the return line 41 and to the pressure line 32 between the pump and the connection of the inlet line 43 of the pressure regulator (regulating valve) 18. The pressure regulator is adjustable and resiliently urged to a closed condition. However, when there is excessive pressure in line 32, resulting, for example, from overrunning of the pump, if any, when the stop valve 14 is closed, the excessive pressure in the inlet line 43 forces the regulating valve 18 to open to permit oil flow to the return line and therethrough to the oil supply 16. The pressure regulator is resiliently closed when the excessive pressure has been relieved.

Branching from the outlet line of the pump unit 10, there is now a line which leads back to the pressure side 32 of the pump 12. In this line there is a circulating valve 22 which opens when the pressure in the line between the pump stop valve 14 and the nozzle shut-off valve 26 is higher than the pressure on the pressure side 32 of the pump.

This is always the case when the pump is not operating but the oil in the line between the pump stop valve 14 and the nozzle shut-off valve 26 expands. In this case, the oil returns to the pressure side 32 of pump 12 by way of the circulating valve 22. The circulating valve 22 is in the form of a check-valve which opens towards the pump 12 and the closure member of which is biased by a closing spring. Its design presents no difficulties because small closing forces will be sufficient for reliable operation and the upper limit of the closing force is merely given by the response pressure of the nozzle shut-off valve 26.

It will be readily apparent that such an additional line can be provided in an existing conventional oil supply system without the need for making any alterations whatsoever to the pump unit 10, the preheater 24, the nozzle shut-off valve 26 or the nozzle 28. All that is necessary is an additional line and the circulating valve 22.

Figure 2:
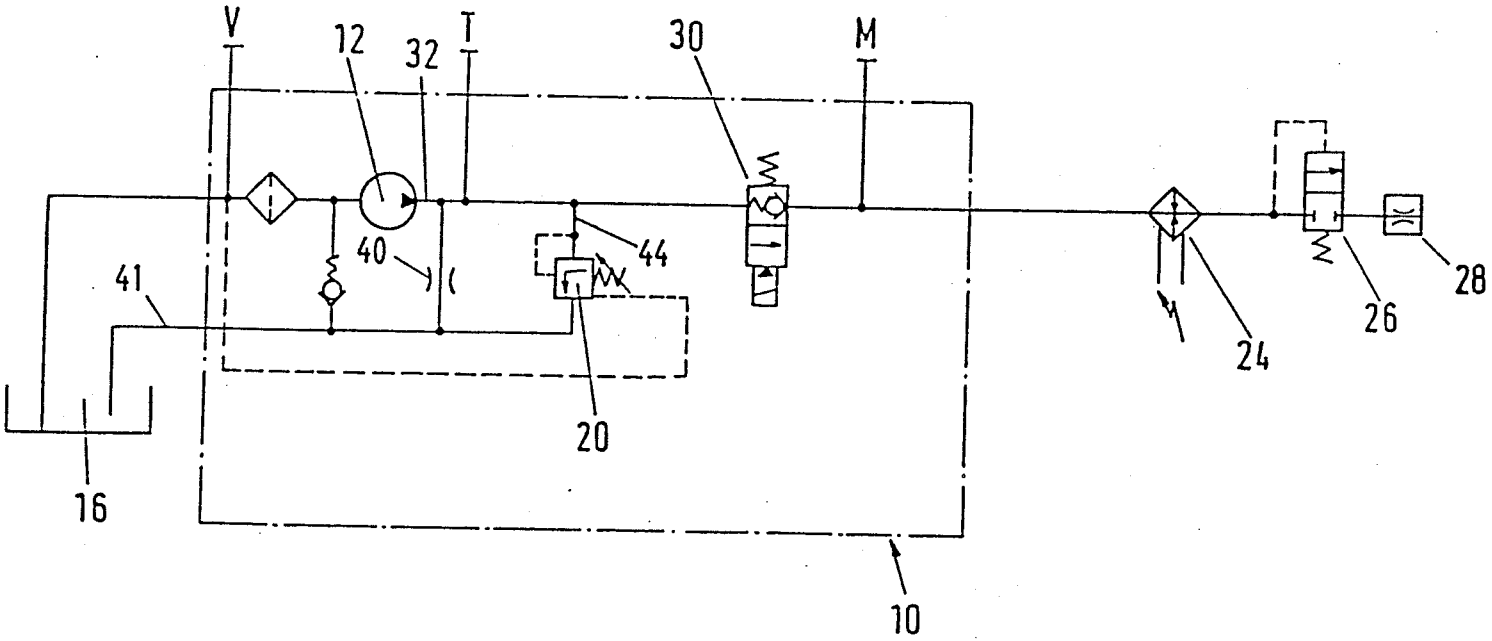
FIG. 2 illustrates a further embodiment of an oil supply system.

FIG. 2 shows a further embodiment in which the circulating valve is directly incorporated in the pump stop valve. A pump unit 10 conveys oil from an oil supply 16 to a nozzle 28 by way of a preheater 24 and a nozzle shut-off valve 26. The pump unit 10 conventionally comprises a pump 12 with a pressure regulating device (regulating valve) 20 at its pressure side 32. Device 20 functions in a manner similar to that of regulator 20 which has its inlet line 44 connected to line between the pump and stop valve 30. The pump stop valve 30 in which the circulating valve is integrated is disposed in the pressure regulating device. In operation, the pump 12 feeds oil from the oil supply 16, the pump stop valve 30 is opened and the oil flows by way of the preheater 24 and nozzle shut-off valve 26 to the nozzle 28. When the pump 12 is shut down, the pump stop valve 30 is also closed. In the closed position of the pump stop valve 30, oil can no longer reach the nozzle from the pressure side 32 of pump 12. However, by reason of the integrated circulating valve, if the oil expands in the line between the pump stop valve 30 and the nozzle shut-off valve 26, it can flow back to the pump pressure side 32. This reliably prevents dripping of the nozzle.

Figure 3:
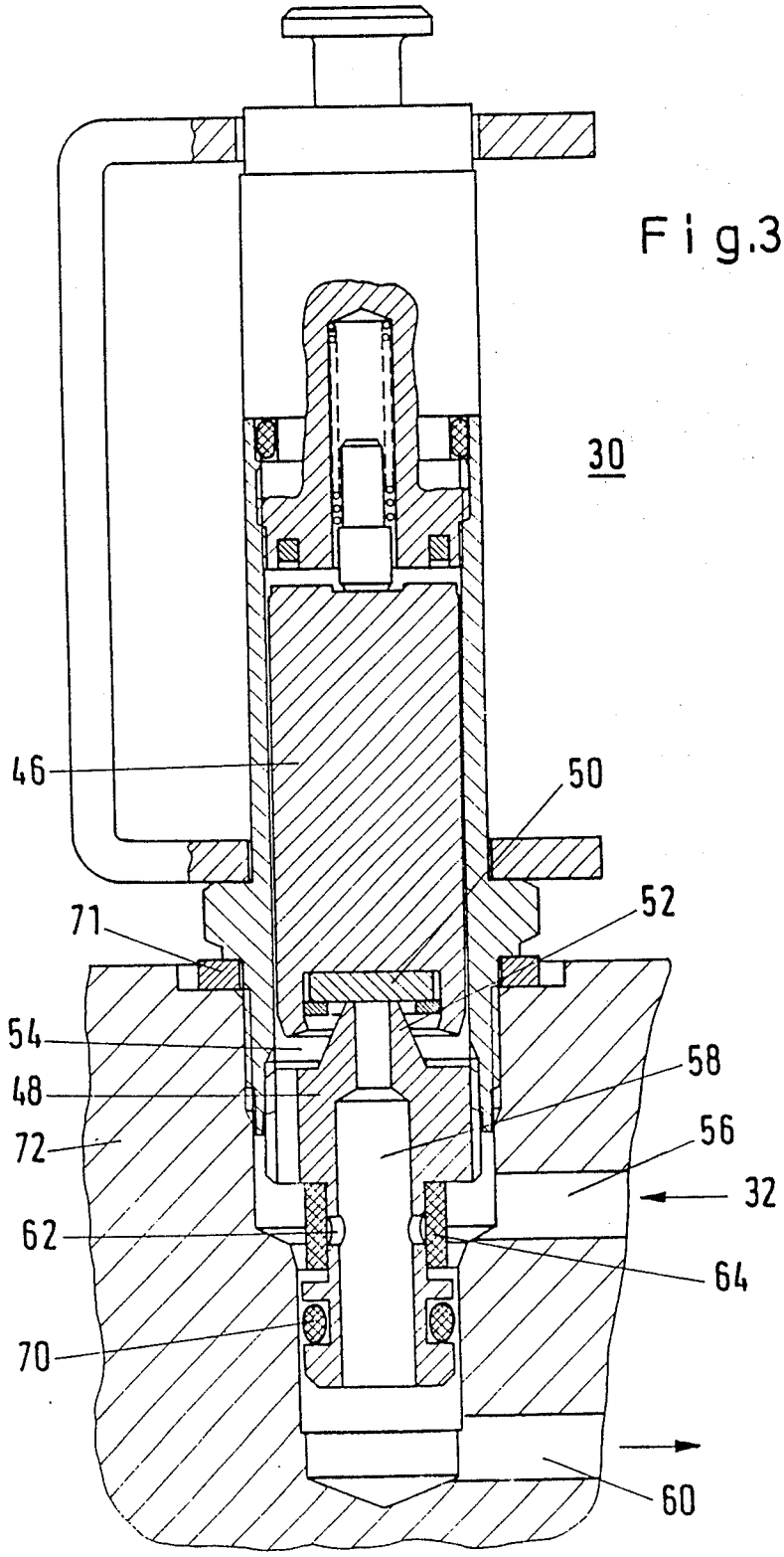
FIG. 3 shows a pump stop valve with an integrated circulating system.

A pump stop valve 30 with an integrated circulating valve is shown in FIG. 3. This valve comprises a base plate 72 with a supply passage 56 and an outlet passage 60 in which a valve body 48 is arranged. With the aid of a seal 70, this valve body 48 prevents the free-flow of oil from the supply passage 56 to the outlet passage 60. There is also a valve actuating element 46 that is mounted in a guide which is likewise built into the base plate 72 and sealed from the base plate with the aid of a seal 71. The valve actuating element 46 can be moved to and from the valve body 48. It can, for example, be the plunger solenoid of an electromagnet.

Between the valve body 48 and base plate 72 there is a passage 54 which communicates with the supply passage 56. In the interior of the valve body 48 there is an intermediate passage 58 which communicates with the outlet passage 60. In the wall of the valve body 48, there is at least one aperture 62 by which the intermediate passage 58 communicates with the supply passage 56. This aperture 62 is covered by an elastic sleeve 64. At the upper end of the valve body 48 there is a valve seat 52 against which a closure member 50 of the valve actuating element 46 presses in the closed position of the pump stop valve 30.

During operation of the pump, oil is fed into the supply passage 56 from the pressure side 32 of the pump. The oil flows through the passage 54 and there builds up a pressure which so presses the elastic sleeve 64 against the valve body 48 that the aperture 62 becomes tightly closed. If, now, the pump stop valve 30 is opened, i.e. the valve actuating element 46 is removed from the valve body 48, the oil can flow through between the closure member 50 and valve seat 52 and then into the outlet passage 60 whence it reaches the nozzle 28 by way of the preheater 24 and the nozzle shut-off valve 26 (FIGS. 1 and 2).

If, now, the burner is shut down, the stop valve 30 is also closed, i.e. the valve actuating element 46 is moved towards the valve body 48, so that the closure member 50 and valve seat 52 form a first valve which blocks the path from the supply passage 56 to the outlet passage 60.

Upon heating of the oil in the outlet passage 60, the pressure there and in the intermediate passage 58 will rise and open the second valve formed by the valve body 48 and the elastic sleeve 64 so that the oil is led through the aperture 62 and the supply passage 56 to the pressure side 32 of the pump 12. An additional withdrawal line for the excess oil is therefore not required.

We claim:

1. An oil supply system for a burner nozzle, comprising an oil supply, a pump having a pressurized fluid outlet connected to the oil supply, a first fluid conduit connected to the outlet, a second fluid conduit adapted for connection to the nozzle, and first valve means for controlling the flow of fluid between the conduits, the first valve means being fluidly connected to the first and second conduits and including second valve means movable between a closed position to block fluid flow therethrough between the first and second conduits and an open position to permit pressurized fluid therethrough from the first conduit to the second conduit, third valve means in parallel to the second valve means and movable between a closed position blocking fluid flow therethrough from the first conduit to the second conduit and an open position for opening under fluid pressure when fluid pressure in the second conduit is higher than that in the first conduit to permit flow therethrough from the second conduit to the first conduit, a return line, and fourth valve means connected to the first conduit to open to relieve excessive pressure in the first conduit by returning oil to the oil supply through the return line and to close when the excessive pressure in the first conduit has been relieved.

2. An oil supply system according to claim 1, characterized in that the third valve means comprises a check valve.

3. An oil supply system according to claim 1, wherein a nozzle shut-off valve is fluidly connected in the second conduit to block fluid flow through the second conduit from the second valve means to the nozzle.

4. An oil supply system according to claim 3, wherein there is provided a pressure regulating device in the first conduit between the pump outlet and the second valve means, characterized that the second valve means comprises a pump stop valve that blocks fluid flow therethrough when the pump is shut off and that the third valve means comprises a circulating valve.

5. An oil supply system according to claim 1 wherein the third valve means has an outlet that is constantly in direct fluid communication with the pump outlet through the first conduit.

6. An oil supply system according to claim 5, characterized in that the second valve means comprises a pump stop valve, that the third valve means comprises a circulating valve and that the circulating valve and pump stop valve are formed as a single valve unit.

7. A oil supply system according to claim 6, characterized in that the pump stop valve has a base member having wall means defining a supply passage, and an outlet passage spaced from the supply passage, and a valve member having a closure member and a first valve having an intermediate passage opening to the closure member extending therethrough and an aperture that communicates with the supply passage and opens to the intermediate passage, and being movable relative to the closure member from a first position for blocking fluid flow from the supply passage to the intermediate passage, to an operating second position to permit fluid flow from the supply passage to the intermediate passage other than through the aperture, and a second valve that opens when the fluid pressure in the outlet passage is higher than the pressure in the supply passage to permit fluid flow through said aperture, the intermediate passage being in constant communication with the outlet passage.

8. An oil supply system according to claim 7, characterized in that the second valve comprises a check valve.

9. An oil supply system according to claim 8, characterized in that the check valve comprises an elastic sleeve mounted on the first valve to block fluid flow from the intermediate passage to the supply passage through the aperture.

* * * * *